US012427620B2

(12) United States Patent
Zhang et al.

(10) Patent No.: US 12,427,620 B2
(45) Date of Patent: Sep. 30, 2025

(54) SURFACE PROCESSING DEVICE

(71) Applicant: Fulian Yuzhan Precision Technology Co., Ltd., Shenzhen (CN)

(72) Inventors: Feng Zhang, Shenzhen (CN); Min Li, Shenzhen (CN); Xiao-Ming Xu, Shenzhen (CN); Bo Long, Shenzhen (CN); Wen-Chao Huang, Shenzhen (CN)

(73) Assignee: Fulian Yuzhan Precision Technology Co., Ltd., Shenzhen (CN)

( * ) Notice: Subject to any disclaimer, the term of this patent is extended or adjusted under 35 U.S.C. 154(b) by 393 days.

(21) Appl. No.: 18/085,909

(22) Filed: Dec. 21, 2022

(65) Prior Publication Data

US 2023/0211458 A1 Jul. 6, 2023

(30) Foreign Application Priority Data

Dec. 31, 2021 (CN) ..... 202111670152.9

(51) Int. Cl.
*B24B 41/04* (2006.01)
*B24B 47/00* (2006.01)

(52) U.S. Cl.
CPC ..... *B24B 41/04* (2013.01); *B24B 47/00* (2013.01)

(58) Field of Classification Search
CPC ..... B24B 47/12; B24B 47/10; B24B 47/16; B24B 7/075; B24B 7/186; B24B 23/03; B24B 23/04; B24B 21/08; B24B 27/0023; B24B 27/0061; B24B 27/0076; B24B 41/04; B24B 41/0475; B24B 41/002; B23Q 2220/002; B24D 7/16; B24D 7/066; B24D 13/20; B25J 11/0065
USPC ..... 451/158, 159, 270, 363
See application file for complete search history.

(56) References Cited

FOREIGN PATENT DOCUMENTS

| | | | | |
|---|---|---|---|---|
| CN | 108422315 | | 8/2018 | |
| CN | 110061589 | | 7/2019 | |
| CN | 110061589 A | * | 7/2019 | |
| CN | 111745504 A | * | 10/2020 | ..... B24B 1/00 |
| CN | 109500718 B | * | 5/2021 | ..... B24B 29/02 |

OTHER PUBLICATIONS

Machine translation of CN-110061589-A (Year: 2019).*
Machine translation of CN-111745504-A (Year: 2020).*
Machine translation of CN-109500718-B (Year: 2021).*

* cited by examiner

*Primary Examiner* — Robert F Neibaur
(74) *Attorney, Agent, or Firm* — ScienBiziP, P.C.

(57) ABSTRACT

A surface processing device includes a machining mechanism and a driving mechanism driving the machining mechanism to polish a workpiece. The machining mechanism includes a machining assembly and a first transmission shaft eccentrically coupled with the machining assembly at a first end. The first transmission shaft rotates to bring the machining assembly into revolving around the first transmission shaft. The driving mechanism includes a motor connected to a second end of the first transmission shaft for outputting power to the machining mechanism. The surface processing device provides smooth machining without the noise of a pneumatically-powered tool.

16 Claims, 6 Drawing Sheets

SURFACE PROCESSING DEVICE

CROSS-REFERENCE TO RELATED APPLICATIONS

This application claims priority to China Application No. 202111670152.9, having a filing date of Dec. 31, 2021, filed in China State Intellectual Property Administration, the entire contents of which is hereby incorporated by reference.

FIELD

The subject matter herein generally relates to machining devices, and more particularly to a surface processing device.

BACKGROUND

Surface processing devices such as an abrasive disc may be attached to a robotic arm and pneumatically-powered to polish a workpiece. However, such surface processing devices, generally pneumatic-powered, have an unstable rotary frequency. The sandpapers or other abrasive on the disc may jump and cause lines and rough areas on the workpiece. Furthermore, the pneumatic-powered machining device is very noisy during operation and can be difficult to maintain.

SUMMARY

An objective of the present disclosure is achieved by providing a surface processing device comprising: a machining mechanism, comprises a machining assembly, a first transmission shaft, a sealing component, and a connecting body. The first transmission shaft extends through the connecting body and is eccentrically coupled with the machining assembly at a first end thereof, the sealing component is arranged between the first transmission shaft and the connecting body; and a driving mechanism connected to the connecting body, the driving mechanism comprises a motor, the motor is connected to a second end of the first transmission shaft to transmit power.

BRIEF DESCRIPTION OF THE DRAWINGS

Implementations of the present technology will now be described, by way of example only, with reference to the attached figures.

DETAILED DESCRIPTION

Figure 1:
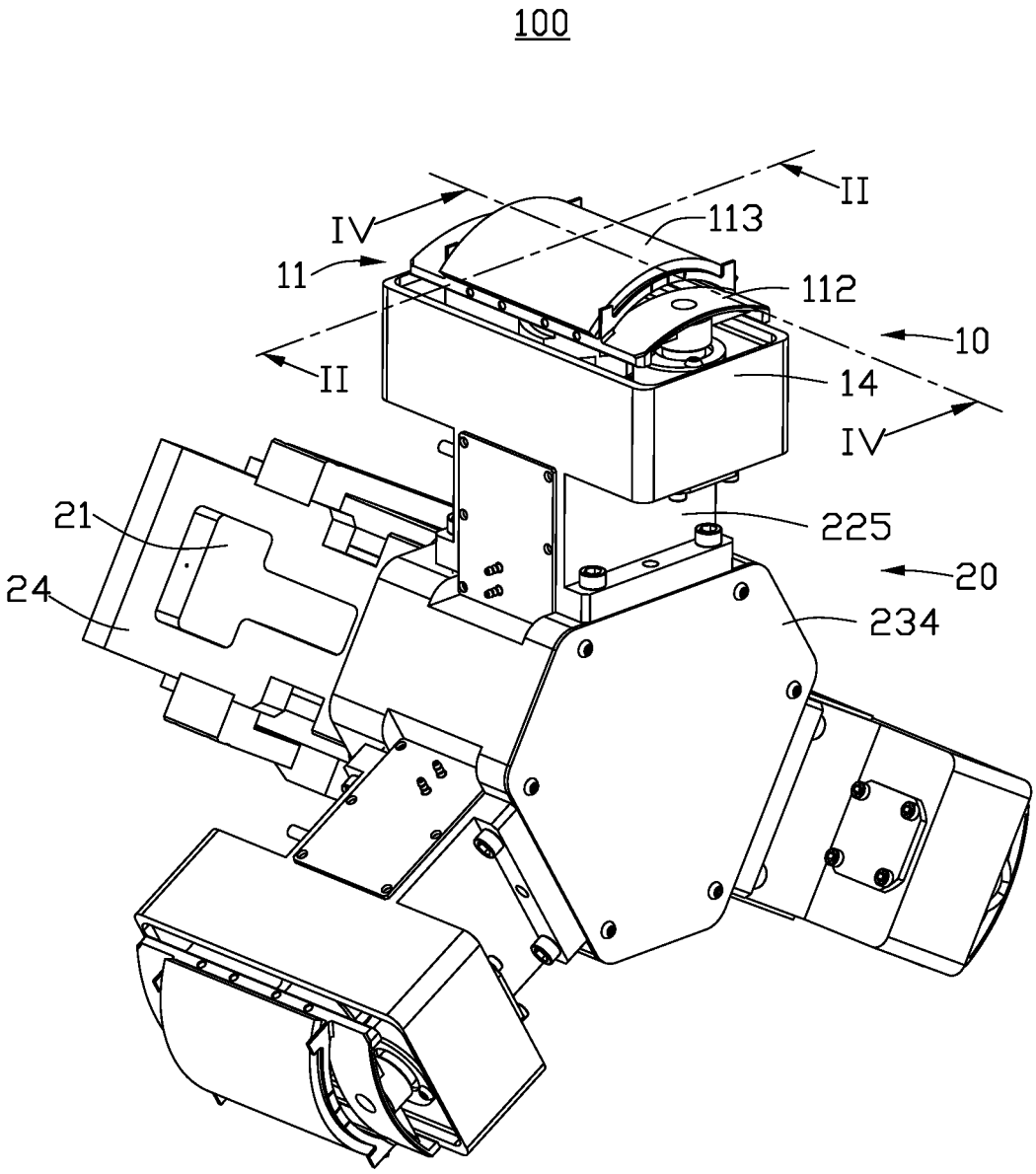
FIG. 1 is a perspective view of an embodiment of a surface processing device according to the present disclosure.

It will be appreciated that for simplicity and clarity of illustration, where appropriate, reference numerals have been repeated among the different figures to indicate corresponding or analogous components. The description is not to be considered as limiting the scope of the embodiments described herein. The drawings are not necessarily to scale and the proportions of certain parts may be exaggerated to better illustrate details and features of the present disclosure.

It should be understood that, the terms "first" and "second" are used to distinguish between elements and are not used to denote a particular order or imply a number of technical features, therefore, unless specifically defined otherwise, features described as "first" and "second" may expressly or implicitly include one or more of the stated features. In the description of the present application, "plurality" means two or more, unless otherwise expressly and specifically defined.

In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described.

The term "comprising," when utilized, means "including, but not necessarily limited to"; it specifically indicates open-ended inclusion or membership in the so-described combination, group, series, and the like.

The hereinafter-described embodiments of the disclosure are presented herein by way of exemplification and not limitation, with reference to the figures.

Figure 2:
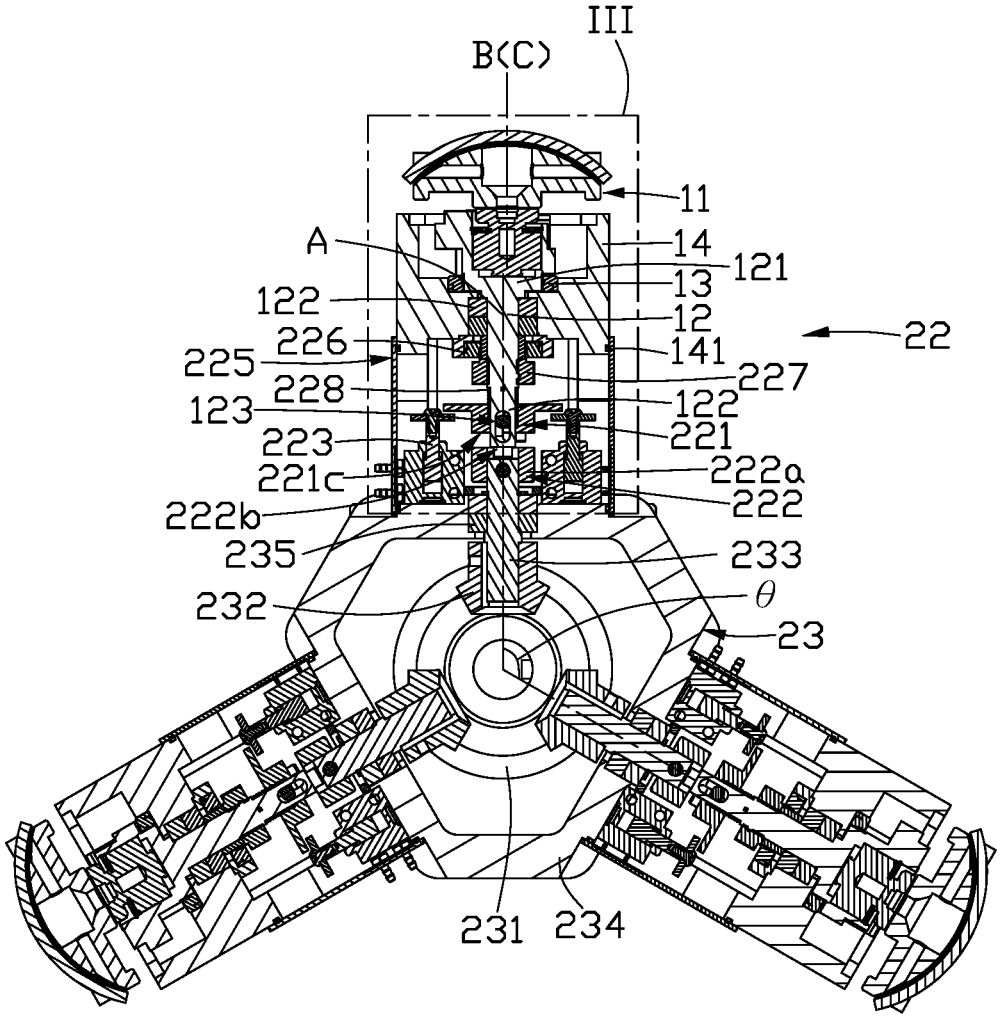
FIG. 2 is a cross-sectional view along line II-II of FIG. 1.
Figure 6:
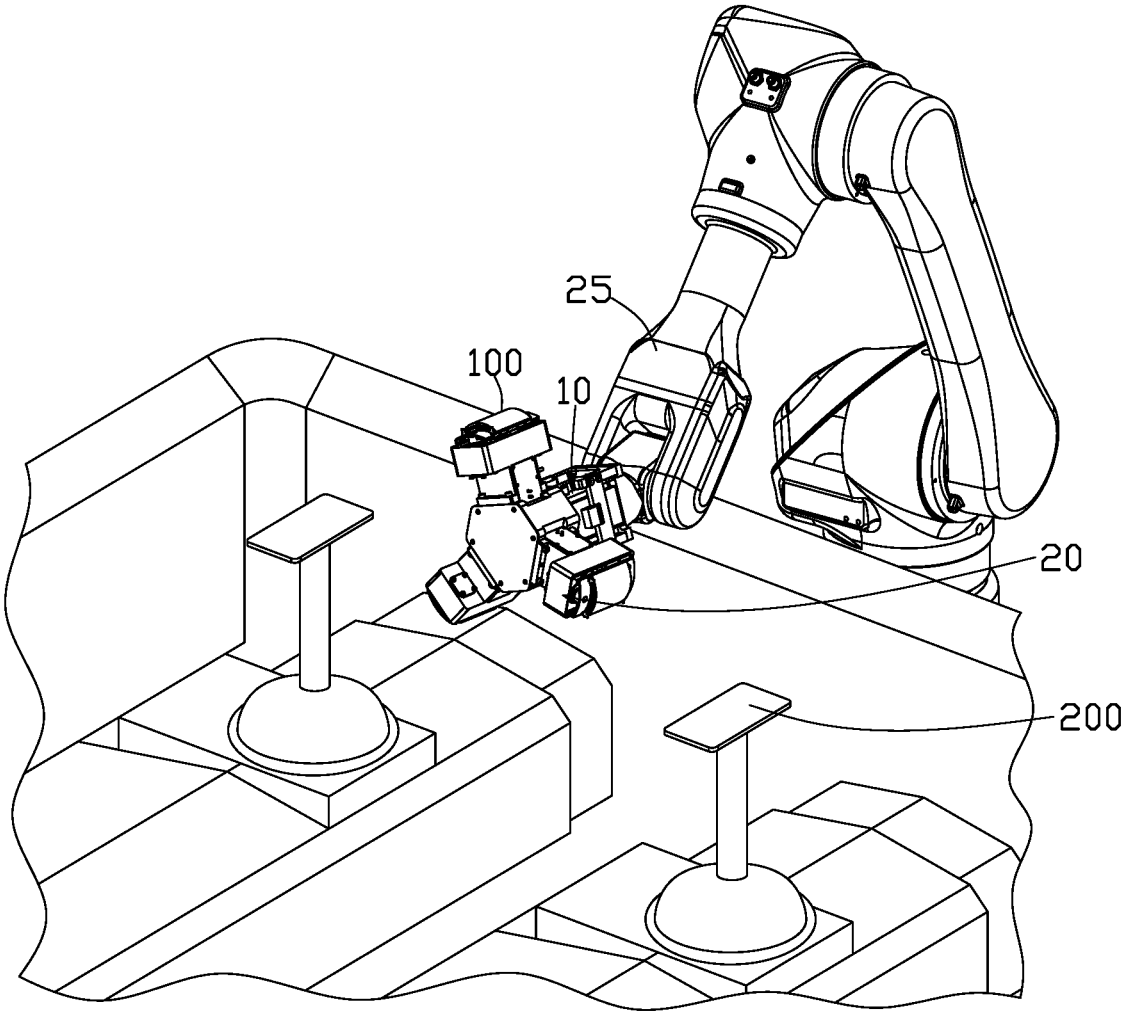
FIG. 6 shows a working surface processing device according to the present disclosure, attached to a robotic arm.

Referring to FIG. 1, FIG. 2, and FIG. 6, a surface processing device 100 is provided. The surface processing device 100 includes a machining mechanism 10 and a driving mechanism 20, the driving mechanism 20 drives the machining mechanism 10 to rotate eccentrically to polish a surface of a workpiece 200 (see FIG. 6). In this embodiment, "rotate eccentrically" means that a second central axis B of the machining mechanism 10 is not in line or coaxial with a first central axis A of a first transmission shaft 12 of the machining mechanism 10. When the first transmission shaft 12 rotates around the first central axis A, the machining mechanism 10 will be driven to move along a circular or elliptical path for polishing the surface of the workpiece 200.

Figure 3:
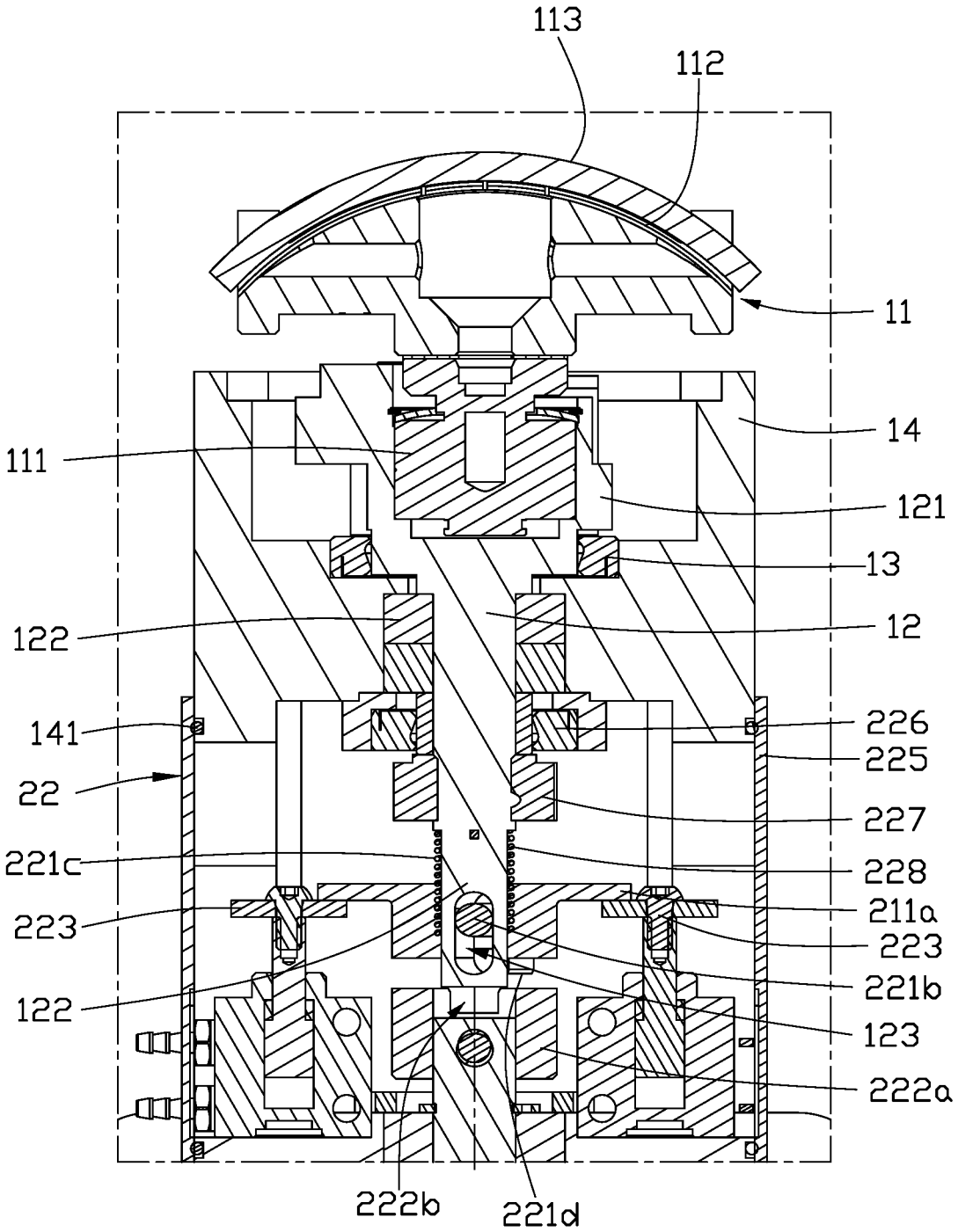
FIG. 3 is an enlarged view of area III of the surface processing device in FIG. 2.

Referring to FIG. 2 and FIG. 3, the machining mechanism 10 further includes a machining assembly 11, a sealing component 13, and a connecting body 14, the connecting body 14 has a box-like construction for receiving the machining assembly 11, a first end 121 of the first transmission shaft 12 is eccentrically coupled with the machining assembly 11, and a second end 122 of the first transmission shaft 12 extends out of the connecting body 14 and is connected to the driving mechanism 20 for power transmission. The sealing component 13 is arranged between the first transmission shaft 12 and the connecting body 14 and prevents polishing solution leaking from the connecting body 14 and stops dust intruding into the connecting body 14. In this embodiment, the sealing component 13 may be a first oil seal, the driving mechanism 20 includes a motor 21, the motor 21 can be one of a servo motor, a stepping motor, a direct current motor, and an alternating current motor, preferably, the motor 21 is a servo motor which is waterproof.

The first transmission shaft 12 is engaged with the motor 21 at a first end 121 and is engaged with the machining assembly 11 eccentrically at a second end 122, thus providing a power connection between the motor 21 and the machining assembly 11. In operation, the machining assembly 11 is driven to rotate by the motor 21 through the first transmission shaft 12, which improves controllability of rotation of the machining assembly 11, reduces jumping of the machining assembly 11 and pneumatic noise, and enables better monitoring of the operation (e.g., rotational speed and output torques of the motor), then an adjustment can be applied according to an actual condition of the machining assembly 11 to enhance a quality of machining.

Referring to FIG. 2 and FIG. 3, in this embodiment, the driving mechanism 20 further includes a clutch assembly 22, the clutch assembly 22 is arranged between the motor 21 and the machining mechanism 10 for transmission of rotational drive power from the motor 21 to the machining mechanism 10, thus where the machining device 100 is equipped with more than one machining mechanism 10, any machining mechanism 10 can be selected for operation.

Specifically, the clutch assembly 22 is arranged between the first shaft 12 and the motor 21, the clutch assembly 22 includes a first connecting member 221 and a second connecting member 222 through a clutch manner, the first connecting member 221 is connected to the second end 122 of the first transmission shaft 12, the second connecting member 222 is mounted on the motor 21. When the first connecting member 221 is coupled to the second connecting member 222, the motor 21 outputs rotational power to the first transmission shaft 12 to drive the machining assembly 11 to rotate for polishing the workpiece 200; when the first connecting member 221 is decoupled from the second connecting member 222, the power transmission between the motor 21 and the first transmission shaft 12 is interrupted and the machining assembly 11 stops polishing the workpiece 200. It should be noted that, the clutch assembly 22 is not necessary, for example, in cases that the transmission of rotational drive power from the motor 21 to the machining mechanism 10 does not require to be switched between rotation and non-rotation.

Referring to FIG. 2 and FIG. 3, in the illustrated embodiment, the first connecting member 221 includes a first clutch member 221*a* and a connecting pin 221*b*, the second end 122 of the first transmission shaft 12 is moveably connected to the first clutch member 221*a* via the connecting pin 221*b*. Specifically, the first clutch member 221*a* defines a through hole 221*c* for receiving the second end 122 of the first transmission shaft 12, the second end 122 of the first transmission shaft 12 defines a position limiting hole 123, the connecting pin 221*b* extends through the position limiting hole 123 and is mounted to sidewall of the through hole 221*c* for connecting the first clutch member 221*a* and the first transmission shaft 12, the position limiting hole 123 is an elongated hole defines a range of movement for the connecting pin 221*b* and thus the first clutch member 221*a*. The second connecting member 222 includes a second clutch member 222*a* positioned coaxially with the first clutch member 221*a*, the second clutch member 222*a* is mounted to the motor 21 for outputting power from the motor 21, the second clutch member 222*a* can be coupled or decoupled from the first clutch member 221*a*.

In particular, the first clutch member 221*a* has a connecting piece 221*d*, the second clutch member 222*a* defines a receiving portion 222*b* for the connecting piece 221*d*, when the first clutch member 221*a* is coupled with the second clutch member 222*a*, the connecting piece 221*d* is received in the receiving portion 222*b*, and when the first clutch member 221*a* is decoupled from the second clutch member 222*a*, the connecting piece 221*d* exits from the receiving portion 222*b*. In the illustrated embodiment, the connecting piece 221*d* is one or more bosses which protrude from the first clutch member 221*a* to the second clutch member 222*a*, the receiving portion 222*b* is one or more notches, each notch can receive one boss, or vice versa.

Referring to FIG. 2 and FIG. 3, in this embodiment, the clutch assembly 22 further comprises a driver 223 and a sensor 224, the driver 223 is connected to the first clutch member 221*a* for driving the first clutch member 221*a* to move towards the second clutch member 222*b* and arrive at a predetermined position P (see FIG. 2). In the predetermined position P, the connecting piece 221*d* is received in the receiving portion 222*b*, that is, the first clutch member 221*a* is coupled with the second clutch member 222*a*. The sensor 224 can confirm that the first clutch member 221*a* driven by the driver 223 is or is not at the predetermined position P. In this embodiment, the driver 223 is a cylinder, the sensor 224 is a proximity sensor. It should be noted that, the driver 223 and the sensor 224 are not necessary, for example, in cases which do not need a driving function or a sensing function.

Referring to FIG. 2 and FIG. 3, in this embodiment, the clutch assembly 22 further includes a casing 225 and a second oil seal 226, the casing 225 is connected to the connecting body 14. The second end 122 of the first transmission shaft 12, the first connecting member 221, the second connecting member 222, and the driver 223 are received in the casing 225, the sensor 224 is mounted on the casing 225. The second oil seal 226 is arranged between the casing 225 and the first transmission shaft 12 for preventing solution, dust, and other impurities from intruding into the casing 225, which improves longevity of the operation of the clutch assembly 22. It should be noted that, the casing 225 and the second oil seal 226 are not necessary, for example, in cases where sealing protection is not required. In further embodiments, a stabilization bearing is arranged for the first transmission shaft 12, positioned between the sealing component 13 and the second oil seal 226 for improving a stability of transmission and reducing friction. Further, a first sealing ring 141 is arranged between the casing 225 and the connecting body 14 for preventing solution from intruding and causing corrosion or unwanted release.

Referring to FIG. 2 and FIG. 3, in this embodiment, the clutch assembly 22 further includes a locking element 227 and an elastic element 228, the second end 122 of the first transmission shaft 12 extends into the casing 225 and is fixed in the locking element 227. The locking element 227 is positioned between the first clutch member 221*a* and the second oil seal 226, and the locking element 227 is mounted to the casing 225 for longitudinally locating the first transmission shaft 12. The elastic element 228 is arranged between the locking element 227 and the first clutch member 221*a* and configured for providing a force to press the first clutch member 221*a* towards the second first clutch member 222*a* (in this embodiment, the driver 223 is configured for driving the first clutch member 221*a* away from the second clutch member 222*a*, against the elastic element 227). In this embodiment, the locking element 227 is a threaded sleeve, the elastic element 228 is a spring pressing the first clutch member 221*a* towards the second first clutch member 222*a*. It should be noted that, the locking element 227 and the elastic element 228 may not be necessary in cases that the first clutch member 221*a* does not require the pressure of an elastic member 228, the locking element 227 and the elastic element 228 can be omitted.

In further embodiments, the connecting piece 221*d* on the first clutch member 221*a* and the receiving portion 222*b* on the second clutch member 222*a* are not aligned, in operation, the motor 21 is activated and rotates the second clutch member 222*a* slowly until the receiving portion 222*b* is aligned with the connecting piece 221*d* on the first clutch member 221*a*, then the first clutch member 221*a* is pressed by the elastic element 228 and the connecting piece 221*d* enters the receiving portion 222*b*. The sensor 224 sends a signal indicating engagement of the first clutch member 221*a* and the second clutch member 222*a*, and the motor 21 outputs a higher speed. When the first clutch member 221*a* requires to be decoupled from the second clutch member 222*a*, the driver 223 a presses the first clutch member 221*a* away from the second clutch member 222*a* against the elastic element 227 until the connecting piece 221*d* is released from the receiving portion 222*b*, then the transmission of power from the motor 21 to the first transmission shaft 12 is interrupted.

Figure 4:
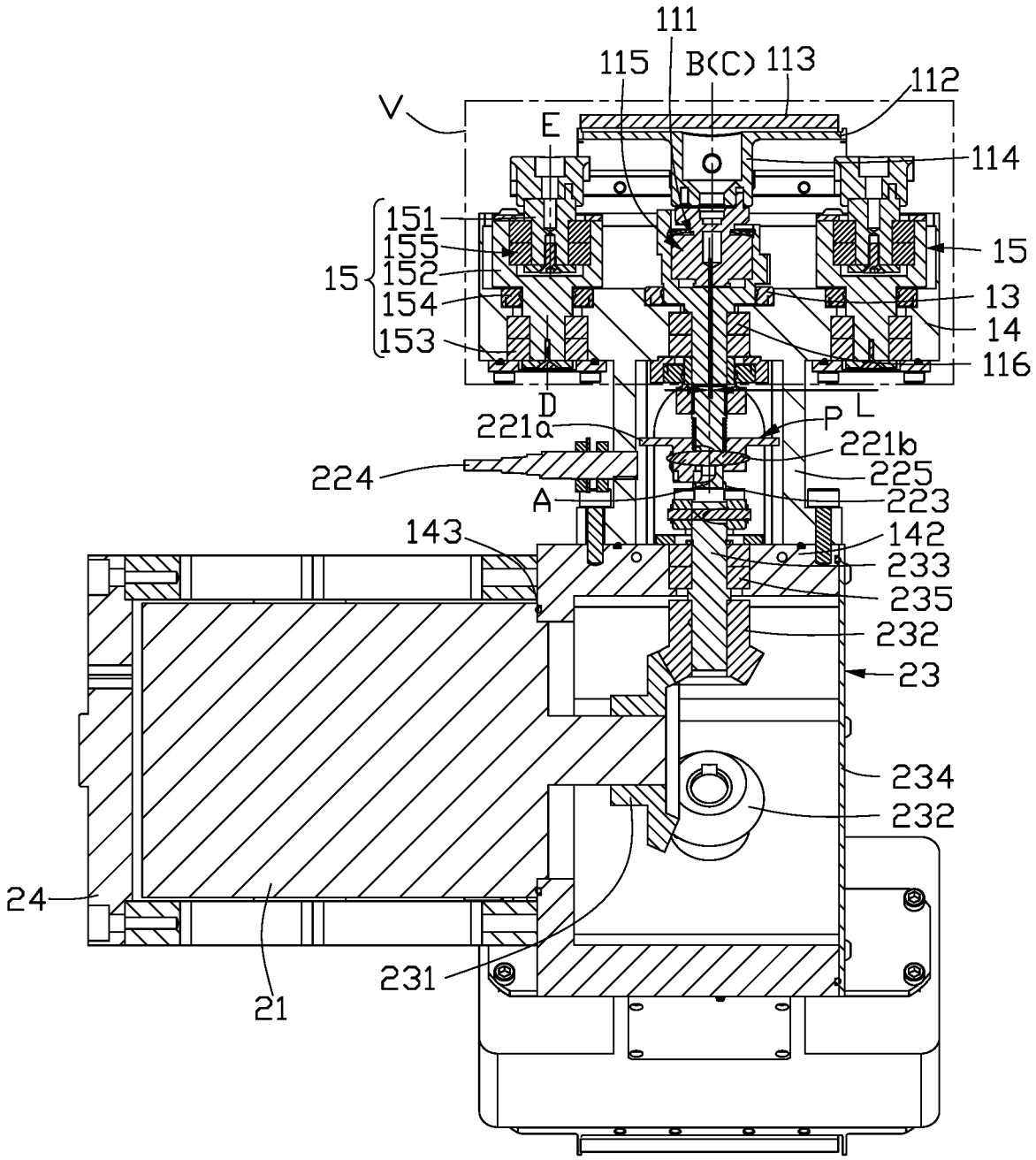
FIG. 4 is a cross-sectional view along line IV-IV of FIG. 1.

Referring to FIG. 2 and FIG. 4, the driving mechanism 20 further comprises a transmission module 23 connected between the clutch assembly 22 and the motor 21. The transmission module 23 includes a first gear 231, a second gear 232, and a second transmission shaft 233. The first gear 231 is connected to an output shaft of the motor 21 for outputting power from the motor 21, the second gear 232 is engaged with the first gear 231, the second transmission shaft 233 is mounted to the second gear 232 at one end and is mounted to the second clutch member 222 of the clutch assembly 22 at the other end for power transmission from the motor 21 to the second clutch member 222. In a further embodiment, the first gear 231 and the second gear 232 are a pair of bevel gears for power transmission between non-parallel shafts, such as the output shaft of the motor 21 and the second transmission shaft 233. It should be noted that, in cases where no clutch assembly 22 is arranged, the second transmission shaft 223 extends towards the connecting body 14 and is connected to the second end 122 of the first transmission shaft 12.

Referring to FIG. 2 and FIG. 4, the transmission module 23 further includes a transmission box 234 and lubricating grease (not shown). The first gear 231 and the second gear 232 are received in the transmission box 234, the end of the second transmission shaft 233 connected to the second gear 232 is inserted into the transmission box 234, the other end of the second transmission shaft 233 is mounted to the second clutch member 222 inserted into the casing 225. The lubricating grease in the transmission box 234 provides lubrication between the first gear 231 and the second gear 232 for reducing wear and tear between the first gear 231 and the second gear 232. In further embodiments, a second sealing ring 142 is arranged between the transmission box 234 and the casing 225 for preventing solution from intruding and causing corrosion or unwanted release.

Referring to FIG. 2 and FIG. 4, in this embodiment, the transmission 23 further includes a third oil seal 235 arranged between the second transmission shaft 233 and the transmission box 234, the third oil seal 235 is configured for sealing a gap between the second transmission shaft 233 and the transmission box 234. The third oil seal 235 prevents water and solution from intruding into the transmission module 23. It should be noted that, the third oil seal 235 may not be necessary in cases where the gap between the second transmission shaft 233 and the transmission box 234 does not require to be sealed.

Referring to FIG. 2 and FIG. 6, the first gear 231 and the second gears 232 are bevel gears, then one first gear 231 can be engaged with the more than one second gears 232, in this embodiment, the surface processing device 100 is provided with more than one machining mechanism 10, the transmission module 23 includes one first gear 231 and more than one second gears 232 and second transmission shafts 233 for power transmission from the motor 21 to the more than one machining mechanism 10. More than one clutch assembly 22 can be arranged for the more than one machining mechanism 10 accordingly. In this embodiment, the more than one machining mechanism 10 is arranged along the outside of the transmission box 234, and an angle θ between second transmission shafts 233 for adjacent machining mechanisms 10 can be in a range of 60°-120°.

Preferably, the surface processing device 100 is provided with three machining mechanisms 10 distributed evenly around the motor 21, the angle θ between adjacent second transmission shafts is 120°, the first gear 231 is engaged with three second gear 231, then the motor 21 can power the three machining mechanisms 10 for machining three workpieces 200, or the motor 21 can power any one or two of the machining mechanisms 10 by controlling the clutch assembly 22 of the three machining mechanisms 10.

Referring to FIG. 1 and FIG. 4, in this embodiment, the driving mechanism 20 further includes a housing 24 for receiving and holding the motor 21, the housing 24 is connected to the transmission box 234. In this embodiment, the surface processing device 100 can be attached to a robotic arm 25 via the housing 24 and be moved by the robotic arm 25 in any direction for machining the workpiece 200.

According to a further embodiment, a third sealing ring 143 is provided between the housing 24 and the transmission box 234 for sealing therebetween.

Figure 5:
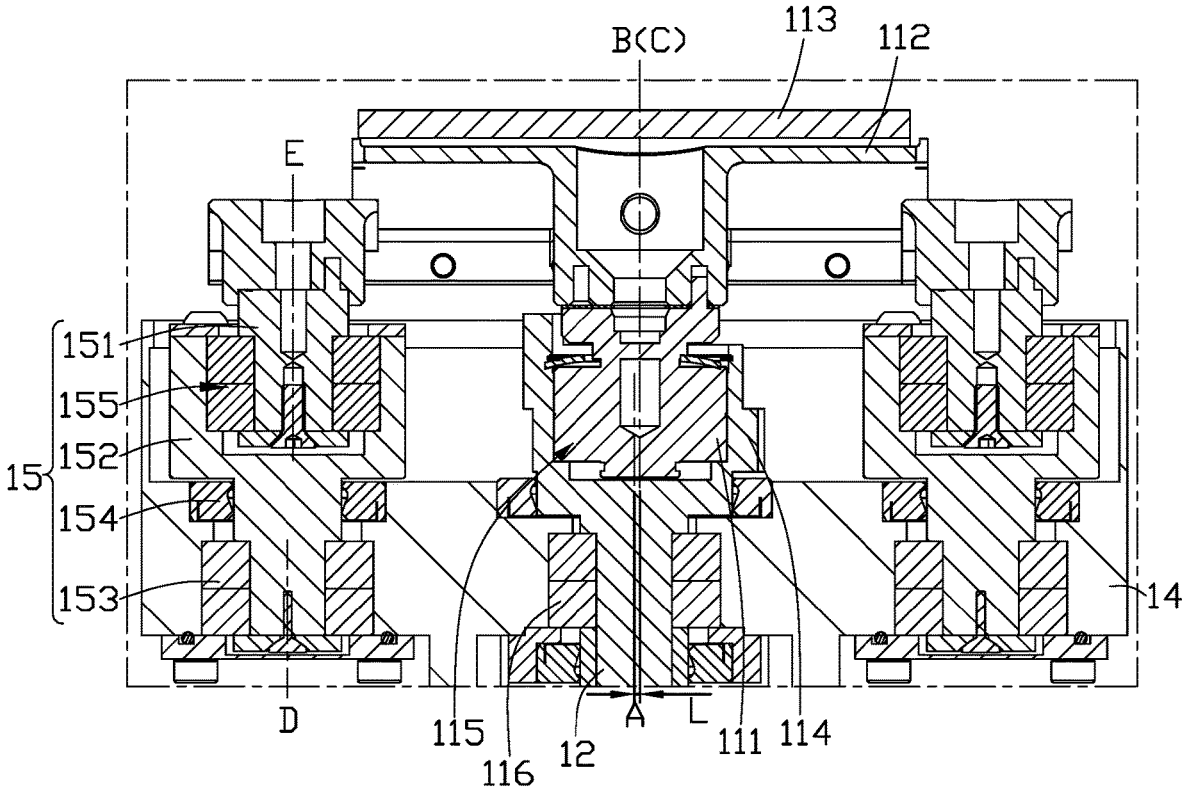
FIG. 5 is an enlarged view of area V of the surface processing device in FIG. 4.

Referring to FIG. 3 and FIG. 5, in this embodiment, the machining assembly 11 includes a first driven shaft 111 with a third central axis coaxial with the second central axis B of the machining mechanism 10, a bracket 112, and a machining element 113. The bracket 112 is mounted on the first driven shaft 111 and configured for supporting the machining element 113, the first end 121 of the first transmission 12 being coupled with the first driven shaft 111. The second central axis B of the first driven shaft 111 is eccentric away from the first central axis A of the first transmission 12 by a preset offset distance L (such as 1.5 mm) In operation, as the first transmission 12 rotates around the first central axis A, the first driven shaft 111 revolves around the first central axis A, the radius of revolution is distance L. The first driven shaft 111 drives the bracket 112 and the machining element 113 on the bracket 112 revolves around the rotation axis A, a central portion of the machining element 113 moving in a circle having a radius of L. In this embodiment, the bracket 112 has an upper surface shaped like a round tile, the machining element 113 is an abrasive or sandpaper spread on the upper surface of the bracket 112.

Referring to FIG. 2 and FIG. 3, in this embodiment, the machining mechanism 10 further includes a first eccentric rotator 114 mounted to the first end 121 of the first transmission shaft 12, the first eccentric rotator 114 has a rotation axis coaxial with the first central axis A of the first transmission shaft 12. The first eccentric rotator 114 defines a first eccentric groove 115, the first eccentric groove 115 has a third central axis C coaxial with the second central axis B of the machining mechanism 10. The first driven shaft 111 is received and rotatably arranged in the first eccentric groove 115, then the first driven shaft 111 is eccentrically coupled to the first transmission shaft 12 and revolves around the first central axis A. It should be noted that, the first driven shaft 111 can be eccentrically coupled to the first transmission shaft 12 in other ways. For example, the first eccentric rotator 114 can be a cam, or the first eccentric rotator 114 and the first end 121 of the first transmission shaft 12 can be integrally formed.

Referring to FIG. 4, in this embodiment, the machining assembly 11 further includes a first bearing 116 between the first eccentric rotator 114 and the connecting body 14, then the first eccentric rotator 114 can be rotatably mounted to the connecting body 14.

Referring to FIG. 4 and FIG. 5, in this embodiment, the machining mechanism 10 further comprises multiple supporting assemblies 15 surrounding the first transmission shaft 12, the supporting assemblies 15 are mounted to the connecting body 14 for supporting the bracket 112, then the bracket 112 and the sandpaper 113 thereon will not tilt or be deflected during operation. In this embodiment, there are two supporting assemblies 15 arranged on both sides of the first transmission shaft 12, the supporting assemblies 15 and the first transmission shaft 12 are disposed in a line along the round tile shape of the bracket 112 and give support at a highest portion of the round tile, therefore, the bracket 112 and the sandpaper 113 thereon will not tilt or be deflected during movement.

In specific, each supporting assembly 15 includes a second driven shaft 151, a second eccentric rotator 152, and a second bearing 153. The second eccentric rotator 152 is rotatably mounted to the connecting body 14 via the second bearing 153 at one end and defines a second eccentric groove 155 for receiving the second driven shaft 151 at the other end. The second driven shaft 151 is rotatably arranged in the second eccentric groove 155 for supporting the machining assembly 11. The second bearing 153 has a similar configuration to that of the first bearing 116. The second eccentric rotator 152 has a fourth central axis D, which is also a rotation axis of the second eccentric rotator 152. The second eccentric groove 155 is defined eccentrically in the second eccentric rotator 152, the second eccentric groove 155 has a fifth central axis E displaced from the fourth central axis D, the second driven shaft 151 is received and rotatably arranged in the second eccentric groove 155. The second driven shaft 151 revolves around the fourth central axis D when the second eccentric rotator 152 rotates around the fourth central axis D.

In operation, the first eccentric rotator 14 is driven to rotate, then the first driven shaft 111 revolves around the first central axis A, driving the bracket 112 and the machining element 113 to move along a circular or elliptical path, then the second driven shaft 151 mounted to the bracket 112 and the machining element 113 revolve around the fourth central axis D synchronously for supporting the bracket 112 and the machining element 113. The bracket 112 and the machining element 113 are thus supported at three portions during operation, which reduces jumping and tilting in operation, improves stability of the bracket 112 and the machining element 113, and enhances machined quality of the workpiece 200.

Referring to FIG. 3, each supporting assembly 15 further includes a fourth oil seal 154 arranged between the second eccentric rotator 152 and the connecting body 14 for sealing the gap therebetween. Therefore, the fourth oil seal 154 prevents the solution from leaking from the connecting body 14 and prevents dust or impurities from entering into the connecting body 14. In this embodiment, each sealing component 13 (i.e. the first oil seal), the second oil seal, the third oil seal, and the fourth oil seal is a skeleton seal.

While the invention has been described in detail in connection with only a limited number of embodiments, it should be readily understood for the skilled in the art that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A surface processing device comprising:

three machining mechanisms, each of the three machining mechanisms comprising a machining assembly, a first transmission shaft, a sealing component, and a connecting body, wherein the first transmission shaft extends through the connecting body, and is eccentrically coupled with the machining assembly at a first end thereof, the sealing component is arranged between the first transmission shaft and the connecting body; and a driving mechanism connected to the connecting body, the driving mechanism comprising a motor, the motor being connected to a second end of the first transmission shaft to transmit power, wherein the driving mechanism further comprises three clutch assemblies mounted to the connecting body, the three clutch assemblies are connected to the three machining mechanisms, respectively, each of the three clutch assemblies comprises a first connecting member and a second connecting member, the first connecting member and the second connecting member are connected through a clutch manner, the first connecting member is connected to the second end of the first transmission shaft of a respective one of the three machining mechanisms;

the first connecting member comprises a first clutch member and a connecting pin, the first clutch member defines a through hole for receiving the second end of the first transmission shaft, the second end of the first transmission shaft defines a position limiting hole, the connecting pin extends through the position limiting hole and is mounted to a sidewall of the through hole for connecting the first clutch member and the first transmission shaft, the position limiting hole is an elongated hole defining a range of movement configured for the connecting pin and the first clutch member, the first clutch member has a connecting piece;

the second connecting member comprises a second clutch member arranged coaxially with the first clutch member, the second clutch member is mounted to the motor for outputting power from the motor, the second clutch member can be coupled or decoupled from the first clutch member, the second clutch member defines a receiving portion for the connecting piece, when the first clutch member is coupled with the second clutch member, the connecting piece is received in the receiving portion, and when the first clutch member is decoupled from the second clutch member, the connecting piece exits from the receiving portion;

the connecting piece is one or more bosses which protrude from the first clutch member to the second clutch member, the receiving portion is one or more notches, each of the one or more notches can receive one of the one or more bosses, or vice versa.

2. The surface processing device of claim 1, wherein each of the three clutch assemblies further comprises:

a driver connected to the first connecting member for driving the first connecting member to move to a predetermined position so that the first connecting member is connected to the second connecting member; and a sensor configured for confirming the first connecting member to be at the predetermined position.

3. The surface processing device of claim 2, wherein each of the three clutch assemblies further comprises:

a casing connected to the connecting body, the casing is configured for receiving the first connecting member, the second connecting member, and the driver, the second end of the first transmission shaft is inserted into the casing; a second oil seal arranged between the casing and the first transmission shaft, wherein the sensor is mounted to the casing, and the sealing component is configured as a first oil seal.

4. The surface processing device of claim 3, wherein each of the three clutch assemblies further comprises:

a locking element sleeved on the first transmission shaft and positioned between the first connecting member and the second oil seal, the locking element being mounted to the casing for locating the first transmission shaft longitudinally; and an elastic element positioned between the locking element and the first clutch member, the elastic element being configured for providing a constant force to press the first clutch member towards the second first clutch member, and the elastic element being a spring.

5. The surface processing device of claim 1, wherein the driving mechanism further comprises a transmission module connected to the connecting body, the transmission module is configured for transmitting power from the motor to the machining mechanism, the transmission module comprises:

a first gear connected to the motor for outputting power from the motor;

a second gear engaged with the first gear; and a second transmission shaft, wherein the second transmission shaft is mounted to the second gear at one end and mounted to the second end of the first transmission shaft at the other end.

6. The surface processing device of claim 1, wherein the driving mechanism further comprises a transmission module, the transmission module is configured for transmitting power from the motor to the three clutch assemblies synchronously, the transmission module comprises:

a first gear connected to the motor for outputting power from the motor;

three second gears engaged with the first gear; and three second transmission shafts, wherein each of the three second transmission shafts is mounted to a corresponding one of the three second gears at one end and mounted to the second connecting member of a corresponding one of the three clutch assemblies at the other end.

7. The surface processing device of claim 6, wherein the transmission assembly further comprises:

a transmission box configured for sealing connection to the three clutch assemblies, wherein the transmission box is configured for receiving the first gear and the three second gears, each of the three second transmission shafts is inserted into the transmission box for connecting to the second gear; and lubricating grease arranged in the transmission box, the lubricating grease providing lubrication between the first gear and each of the three second gears.

8. The surface processing device of claim 7, wherein the transmission assembly further comprises a third oil seal, the third oil seal is arranged between each of the three second transmission shafts and the transmission box.

9. The surface processing device of claim 6, wherein the first gear and the three second gears are bevel gears;

the three machining mechanisms are arranged around the transmission box, and an angle θ between two second transmission shafts of two adjacent machining mechanism is in a range of 60°-180°.

10. The surface processing device of claim 6, wherein the three machining mechanisms are distributed evenly around the transmission box, and an angle θ between two second transmission shafts of two adjacent machining mechanism is 120°.

11. The surface processing device of claim 6, wherein the driving mechanism further comprises a housing connected to the transmission box, the housing is configured for receiving and holding the motor, the surface processing device is attachable to a robotic arm via the housing.

12. The surface processing device of claim 1, wherein the machining assembly comprises a first driven shaft connected to the first end of the first transmission shaft;

the first driven shaft is arranged eccentrically from the first transmission shaft and revolves around the first transmission shaft when the first transmission shaft rotates.

13. The surface processing device of claim 12, wherein the machining assembly further comprises a first eccentric rotator coupled to the first end of the first transmission shaft, the first eccentric rotator defines a first eccentric groove, the first driven shaft is received and rotatably arranged in the first eccentric groove.

14. The surface processing device of claim 12, wherein the machining assembly further comprises:

a first bearing arranged between the first eccentric rotator and the connecting body;

a machining element configured for machining the workpiece, and the machining element being an abrasive or sandpaper; and a bracket mounted on the first driven shaft at an end away from the first transmission shaft, the bracket is configured for supporting the machining element.

15. The surface processing device of claim 14, wherein the machining mechanism further comprises multiple supporting assemblies surrounding the first transmission shaft, the supporting assemblies are mounted to the connecting body for supporting the bracket;

each of the multiple supporting assemblies comprises a second eccentric rotator, a second driven shaft, and a second bearing;

the second eccentric rotator is rotatably mounted to the connecting body via the second bearing at one end and eccentrically connected to the second driven shaft at the other end, the second driven shaft is rotatably arranged in the second eccentric groove for supporting the machining assembly;

the second bearing has a similar configuration to that of the first bearing, the second eccentric rotator has a fourth central axis, which is also a rotation axis of the second eccentric rotator, the second eccentric groove is defined eccentrically in the second eccentric rotator;

when the first eccentric rotator rotates, the second driven shaft revolves around the second eccentric rotator synchronously, and the second eccentric rotator rotates.

16. The surface processing device of claim 15, wherein each of the multiple supporting assemblies further comprises a fourth oil seal arranged between the second eccentric rotator and the connecting body.

* * * * *